US007046265B2

(12) United States Patent
Shirakawa et al.

(10) Patent No.: US 7,046,265 B2
(45) Date of Patent: May 16, 2006

(54) POWER-SAVING THERMAL HEAD

(75) Inventors: Takashi Shirakawa, Iwate-ken (JP); Satoru Sasaki, Iwate-ken (JP); Hirotoshi Terao, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 413 days.

(21) Appl. No.: 10/058,815

(22) Filed: Jan. 28, 2002

(65) Prior Publication Data

US 2002/0158959 A1 Oct. 31, 2002

(30) Foreign Application Priority Data

Jan. 29, 2001 (JP) ..... 2001-019940
Mar. 27, 2001 (JP) ..... 2001-089453
Apr. 16, 2001 (JP) ..... 2001-117205

(51) Int. Cl.
*B41J 2/335* (2006.01)

(52) U.S. Cl. ..... 347/202
(58) Field of Classification Search ..... 347/200, 347/202, 205; 219/216
See application file for complete search history.

(56) References Cited

U.S. PATENT DOCUMENTS 4,096,510 A * 6/1978 Arai et al. ..... 219/216
5,444,475 A * 8/1995 Mitani ..... 347/200
5,949,465 A * 9/1999 Taniguchi et al. ..... 347/205

* cited by examiner

*Primary Examiner*—K. Feggins
(74) *Attorney, Agent, or Firm*—Brinks Hofer Gilson & Lione

(57) ABSTRACT

A thermal head of the present invention is provided with a thermal insulation layer formed on a radiative substrate, a plurality of heating resistors formed on a top face of the thermal insulation layer, a plurality of power suppliers connected to the heating resistors to form a heater on a part of the heating resistors, and a protection layer that covers surfaces of at least the heating resistors and the power suppliers, wherein the thermal insulation layer is formed by laminating an inorganic high thermal insulation layer including a complex oxide ceramic containing Si, transition metal, and oxygen or including complex nitride ceramic containing Si, transition metal, and nitrogen on an organic thermal insulation layer that contains polyimide resin.

2 Claims, 7 Drawing Sheets

POWER-SAVING THERMAL HEAD

BACKGROUND OF THE INVENTION

1. Field of the Invention

This invention relates to a high efficiency thermal head to be used for a thermal printer and a method for manufacture of the thermal head.

2. Description of the Related Art

Generally as shown in FIG. 9, a conventional thermal head is provided with a glaze thermal insulation layer 102 formed of alumina having a thickness of approximately 80 μm formed on the top face of a radiative substrate 101 and a convex 102*a* having a height of approximately 5 μm formed by means of the photolithographic technique on the top face of the glaze insulation layer 102.

Furthermore, a heating resistor 103 formed of Ta—$SiO_2$ is formed on the top face of the glaze thermal insulation layer 102 by means of the sputtering technique and photolithographic technique so as to form a pattern. Furthermore, a part of the heating resistor 103 functions as a heating element 103*a* arranged at an equal intervals on the space between a common electrode 104*a* and an individual electrode 104*b*, which will be described hereinafter.

Herein, a heating resistor that has been subjected to high temperature stabilization heat treatment at 500 to 800° C. after film forming is used as the heating resistor 103. The high temperature stabilization heat treatment of the heating resistor 103 brings about the improved characteristic of the heating resistor 103 so that heating in printing does not result in increased resistance loss, and so that a heating head prints without irregular printing density.

Therefore, the high temperature stabilization heat treatment of the heating resistor 103 is required inevitably for the conventional thermal head.

Furthermore, on the top face of the heating resistor 103, a power supplier (which includes the common electrode 104*a* and the individual electrode 104*b*) that functions to supply electric energy to the heating resistor 103 having a thickness of approximately 2 μm consisting of a metal material such as Al, Cu, or Au is formed by means of sputtering, and the common electrode 104*a*, the individual electrode 104*b*, and outside-connection terminals (not shown in the drawing) of the electrodes 104*a* and 104*b* are formed by means of the photolithographic technique.

Furthermore, at least on the top faces of the heating resistor 103 and the power supplier, a protection layer 105 that functions to prevent wearing and oxidation of the heating resistor 103 and the electrodes 104*a* and 104*b* is formed.

The protection layer 105 is formed of a layer having a thickness of approximately 5 to 10 μm consisting of hard ceramic such as Si—O—N or Si—Al—O—N formed by means of sputtering.

In the case of the conventional thermal head, a current is supplied selectively to the common electrode 104*a* and individual electrode 104*b* to heat the heating element 103*a* so as to transfer ink of an ink ribbon onto plain paper and so as to print a desired character or a desired image. Otherwise, a desired character or a desired image is printed directly on heat sensitive paper.

A thermal printer having a conventional thermal head as described hereinabove that is portable and driven by use of a battery has been available commercially. The thermal head of the portable printer as described hereinabove is the biggest power consumer, and it particularly causes the short life of a battery. A power-saving thermal head has been expected to be developed.

However, in the possible case where the thermal efficiency of a conventional thermal head is improved to save power by reserving the heat of the glaze thermal insulation layer 102 formed of glass glaze, the film thickness of the glaze should be thick. However, formation of a glaze thermal insulation layer 102 having a thickness thicker than conventionally used 80 μm is difficult technically and the thickness is limited by the film forming technique used. As the result, no power-saving thermal head has been developed.

Furthermore, a high temperature stabilization heat treatment at a temperature of 500 to 800° C. is required to obtain a conventional thermal head after a heating resistor 103 is molded. However, the thermal treatment results in a complex manufacturing process. Furthermore, the thermal treatment requires calcination equipment, which results in high cost.

SUMMARY OF THE INVENTION

The present invention has been accomplished in view of the abovementioned problem, and provides a thermal head and a method for manufacture of the same that is capable of saving power and bringing about the low cost.

To solve the abovementioned problem, a first embodiment comprises a thermal head provided with a thermal insulation layer on a radiative substrate, a plurality of heating resistor elements formed on a top face of the thermal insulation layer, a power supplier having an individual electrode and a common electrode connected to the heating resistor elements to supply power to a heating resistor, and a protection layer that covers surfaces of at least the heating resistor elements and the power supplier. The thermal insulation layer includes a lamination of an inorganic thermal insulation layer having a ceramic containing Si, transition metal, and oxygen and/or nitrogen on an organic thermal insulation layer that includes polyimide resin.

To solve the abovementioned problem, a second embodiment comprises a thermal head provided with a thermal insulation layer on a radiative substrate, a plurality of heating resistor elements on a top face of the thermal insulation layer, a power supplier having an individual electrode and a common electrode connected to the heating resistor elements to supply power to a heating resistor, and a protection layer that covers surfaces of at least the heating resistor elements and the power supplier. The thermal insulation layer includes a lamination of an inorganic thermal insulation layer having ceramic containing Si, transition metal, and oxygen and/or nitrogen on an organic thermal insulation layer that includes a polyimide resin, an inorganic protection layer that includes an oxide of Si or Al, or a nitride, or a carbide is additionally formed on a top face of the inorganic thermal insulation layer, and the heating elements are formed on a top face of the inorganic protection layer.

To solve the abovementioned problem, a third embodiment comprises a thermal head provided with a thermal insulation layer formed on a radiative substrate, a plurality of heating resistor elements formed on a top face of the thermal insulation layer, a power supplier having an individual electrode and a common electrode connected to the heating resistor elements to supply power to a heating resistor, and a protection layer that covers surfaces of at least the heating resistor elements and the power supplier. The thermal insulation layer includes a lamination of an inorganic thermal insulation layer having ceramic containing Si, transition metal, and oxygen and/or nitrogen on the organic thermal insulation layer that includes polyimide resin, and the protection layer is formed with a ceramic film that includes the same material as that of the inorganic thermal insulation layer.

To solve the abovementioned problem, a fourth embodiment comprises a thermal head provided with a thermal insulation layer formed on a radiative substrate, a plurality of heating resistor elements formed on a top face of the thermal insulation layer, a power supplier having an individual electrode and a common electrode connected to the heating resistor elements to supply power to a heating resistor, and a protection layer that covers surfaces of at least the heating resistor elements and the power supplier. The thermal insulation layer has an organic thermal insulation layer that includes polyimide resin and a thermal diffusion layer is formed on a top face of the heating resistor elements with interposition of an electric insulation film.

To solve the abovementioned problem, a fifth embodiment comprises a thermal head provided with a thermal insulation layer formed on a radiative substrate, a plurality of heating resistor elements formed on a top face of the thermal insulation layer, a power supplier having an individual electrode and a common electrode connected to the heating resistor elements to supply power to a heating resistor, and a protection layer that covers surfaces of at least the heating resistor elements and the power supplier. The thermal insulation layer has an organic thermal insulation layer that includes polyimide resin and a thermal diffusion layer is formed on bottom faces of the heating resistor elements with interposition of an electric insulation film.

DETAILED DESCRIPTION OF THE PREFERRED EMBODIMENTS

Figure 1:
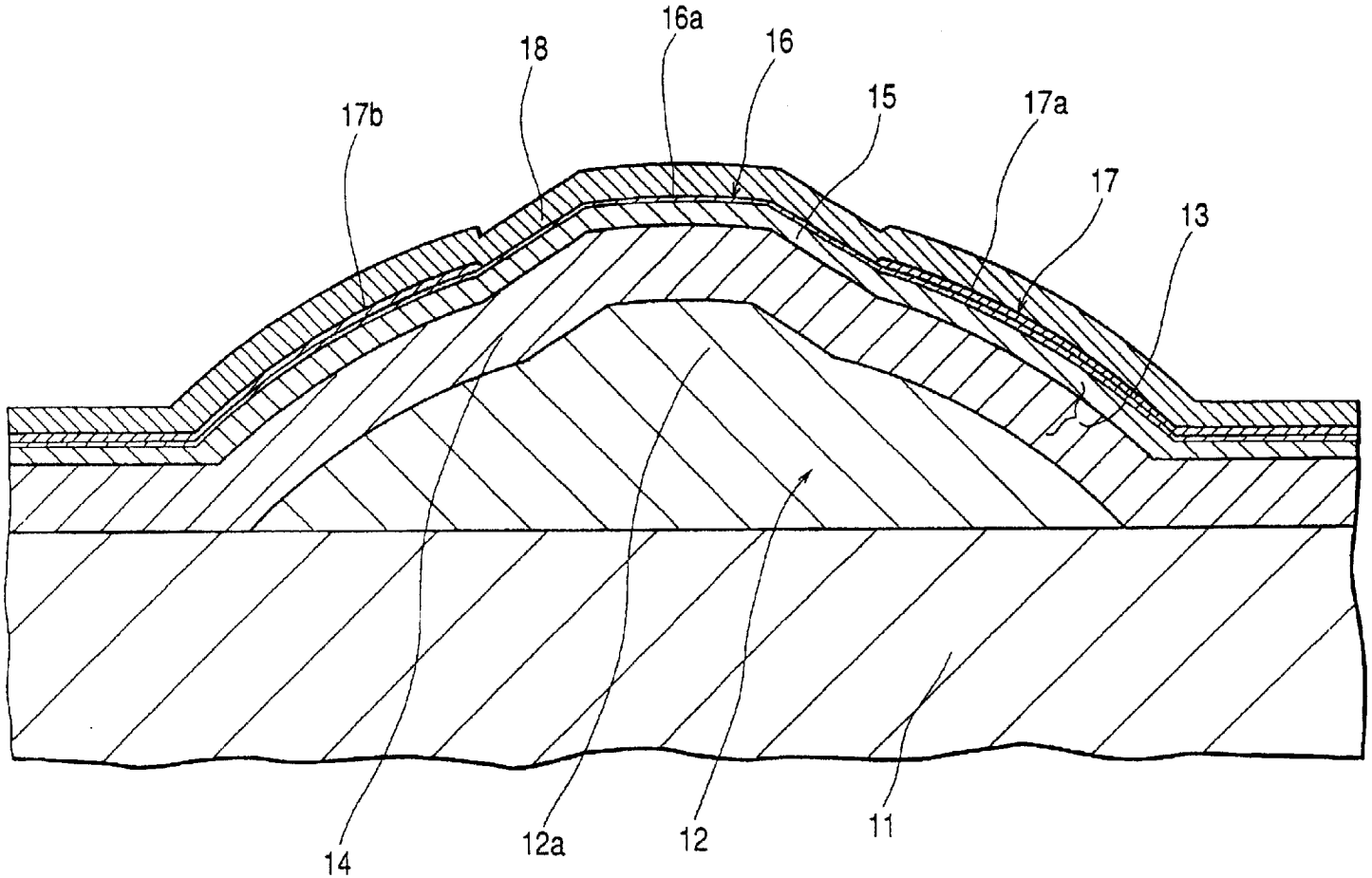
FIG. 1 is a partial cross sectional view showing the structure of a thermal head in accordance with the first embodiment of the present invention.

A thermal head of the present invention and a method for manufacture of a thermal head of the present invention will be described in detail hereinafter with reference to the drawings. FIG. 1 is a partial cross sectional schematic view in accordance with the first embodiment of the present invention, FIG. 2 impartial cross sectional schematic view for describing the second embodiment of the present invention, and FIG. 3 is a diagram showing the resistance value change characteristic of a heat resistor in the case of with and without thermal insulation layer in accordance with the present invention At first, a thermal head of the first embodiment of the present invention is provided with a glaze layer 12 having an approximately semicircle cross section comprising a glass glaze with the film thickness of 30 to 80 μm formed on the top face of a radiative substrate 11 that includes alumina as shown in FIG. 1.

On the top of the glaze layer 12, a convex 12*a* having an approximately trapezoidal cross section having a height of approximately 5 μm is formed by means of the photolithographic technique.

On the top face of the radiative substrate 11 including the glaze layer 12, a thermal insulation layer 13 comprising an organic thermal insulation layer 14 and an inorganic high thermal insulation layer 15 is formed.

The organic thermal insulation layer 14 having a film thickness of 10 to 30 μm includes polyimide resin deposited using an evaporation deposition technique. The thermal diffusivity of the organic thermal insulation layer 14 is very small (approximately 0.11 $mm^2$/sec), that is, approximately ¼ in comparison with the glaze layer 12 having a thermal diffusivity of approximately 0.45 $mm^2$/sec. The material is the best material for thermal insulation currently. However, the highest serviceable temperature of the organic thermal insulation layer 14 is approximately 500° C.

The inorganic high thermal insulation layer 15 having a thickness of 5 to 20 μm formed on the top face of the organic insulation layer 14 includes a complex oxide ceramic containing Si, a plurality of transition metals, and oxygen.

A plurality of several transition metals are selected from among the plurality of transition metals including, for example, Ta, W, Cr, Ti, Zr, Mo, Nb, Hf, V, Fe, Ni, and Co.

Furthermore, the inorganic high thermal insulation layer 15 may contain a complex nitride ceramic formed of Si, a plurality of transition metals, and nitrogen.

The thermal diffusivity of such inorganic high thermal insulation layer 15 ranges from 0.3 to 0.5 $mm^2$/sec.

Furthermore, a resistor layer includes a high melting point cement such as Ta—$SiO_2$ having a thickness of approximately 0.3 μm is formed on the top face of the insulation layer 13 comprising the organic thermal insulation layer 14 and the inorganic high thermal insulation layer 15 by means of sputtering, and the resistor layer is patterned by means of the photolithographic technique to form a plurality of heating resistors 16.

A heating element 16*a* of the heating resistor 16 is formed between a common electrode 17*a* and an individual electrode 17*b*, which will be described hereinafter.

The temperature of the heating element 16*a* rises to 400 to 500° C. during printing, which temperature is close to the limit of thermally endurable temperature of the organic thermal insulation layer 14. At that time, the temperature of the organic thermal insulation layer 14 is thermally protected by the inorganic high thermal insulation layer 15 and the temperature rising is suppressed, and the polyimide resin of the organic thermal insulation layer 14 will not be damaged.

The power supplier 17 comprising the common electrode 17*a* and individual electrode 17*b* formed by patterning electrode material having aluminum, copper, or gold deposited so as to have a thickness of 1 to 2 μm by means of the photolithographic technique is provided on the top face of the heating resistor 16.

Furthermore, an outside-connection terminal (not shown in the drawing) is formed on the electrodes 17*a* and 17*b* so as to supply electric energy to the electrodes 17*a* and 17*b* to heat the heating element 16*a*.

Furthermore, an oxidation resistant and wear resistant protection layer 18 that includes Si—Al—O—N covers the respective top faces of the heating resistor 16 and the electrodes 17*a* and 17*b*.

A method for manufacture of a thermal head in accordance with the first embodiment of the present invention will be described hereunder. At first, the glaze layer 12 is formed on the radiative substrate 11 by means of sputtering so as to form the convex 12*a* having a thickness of approximately 5 μm projectingly by means of the photolithographic technique in the first process.

Next, the thermal insulation layer 13 is formed on the radiative substrate 11 in the first step. In the first process, the organic thermal insulation layer 14 having a film thickness of 10 to 30 μm that includes polyimide is formed by an evaporation polymerization technique on the radiative substrate 11 including the glaze layer 12 in the state that the radiative substrate 11 is being heated to a temperature of approximately 200° C.

Thereafter, the organic thermal insulation layer 14 is subjected to heat treatment at a temperature of 400 to 500° C., that is a temperature near the thermally damaging temperature to stabilize the film quality of the organic thermal insulation layer 14 and to increase the adhesion between the radiative substrate 11 and the glaze layer 12.

In the first process, the top face of the heat-treated organic thermal insulation layer 14 is subjected to oxygen or nitrogen reactive sputtering by use of a sputtering target comprising a sintered material that includes Si and a plurality of transition metals or silicide under the condition in which the sputtering film forming pressure is set as high range as 1.0 Pa to 3.0 Pa. Thereby, the inorganic high thermal insulation layer 15 comprising columnar crystals having a thickness of 1 to 10 μm that includes a complex oxide ceramic or complex nitride ceramic is laminated, and the first process is brought to an end.

Next, in the second process, the high melting point cermet heating resistor 16 having a film thickness of approximately 0.3 μm having Ta—$SiO_2$ formed by sputtering in a temperature range from 100 to 300° C. is formed on the top face of the thermal insulation layer 13.

Next, in the third process, the common electrode 17*a* and the individual electrode 17*b* of the power supplier 17 are formed on the top face of the heating resistor 16 by means of sputtering and photolithographic technique respectively. Next, in the fourth process, the protection layer 18 for covering the surface of the heating resistor 16 and the power supplier 17 is formed.

A current is supplied to the individual electrode 17*b* of the thermal head as described hereinabove selectively based on the printing information to thereby heat the heating element 16*a* of the heating resistor 16 selectively, and to thereby color thermosensitive paper or transfer ink of an ink ribbon onto plain paper. As the result, a desired high quality character or desired high quality image is printed.

A high temperature heat treatment process applied at a temperature of 500 to 800° C. to stabilize the heating resistor 16 as described in the related art is omitted in the method for manufacture of a thermal head of the present invention.

The reason is that the element contained in the inorganic high thermal insulation layer 15, for example, Si, oxygen, or nitrogen, diffuses into the heating resistor 16 when the heating resistor 16 is heated, and functions to increase the resistance ratio of the heating resistor 16 because the underlayer of the heating resistor 16 comprises the inorganic high thermal insulation layer 15.

Because the reduction characteristics of the essential resistance ratio of the heating resistor 16 is offset by utilizing the function, the stabilization heat treatment process to be applied to the heating resistor 16 can be omitted in the case of the method for manufacture of a thermal head in accordance with the present invention.

The relation between the supplied power and the resistance change rate of the heating resistor 16 that has been manufactured without the stabilization heat treatment process is obtained by means of the step stress test (SST), and the obtained result is shown in FIG. 3.

The curve B shown in FIG. 3 is obtained by applying the SST in the case where the heating resistor 16 is formed (not shown in the drawing) directly on the top face of the glaze layer 12, and it is found that the resistance change rate changes toward the negative side sharply and the resistance value drops sharply concomitantly with the supplied power increase (the heating temperature rises).

The increased resistance change rate as shown in the case of the curve B causes increased resistance value drop of the heating resistor 16 and lowered temperature of the heater 16*a* when the heating density of the printing is high, and results in the low printing density.

The resistance value drop of the heating element 16*a* decreases and the temperature of the heater 16*a* increases to result in the high printing density when the heating density for printing is low. In other words, the printing density changes irregularly depending on the magnitude of the printing density, and the irregular printing density change results in poor printing quality.

On the other hand, in the case of the thermal head manufactured according to the method of the present invention, because the heating resistor 16 is formed on the top face of the glaze layer 12 with interposition of the inorganic high thermal insulation layer 15 of the thermal insulation layer 13, the curve A shown in FIG. 3 is obtained. In other words, the resistance value will not drop even though the supplied power is increased in the range lower than 0.15 W/d, namely practically used supplied power range, and the temperature of the heating resistor 16 is increased. The curve A shows the flat mode that is equivalent to the curve obtained in the case of a conventional thermal head that has been subjected to high temperature stabilization heat treatment.

Based on the behavior shown in FIG. 3, it is found that the thermal head manufactured according to the method of the present invention does not cause the problem though the high temperature heat treatment of the heating resistor 16 is omitted.

Alternatively, a method may be employed in which the glaze layer 12 is not formed and the thermal insulation layer 13 having a convex on a part of the thermal insulation layer 13 is formed directly on the substrate 11.

Figure 2:
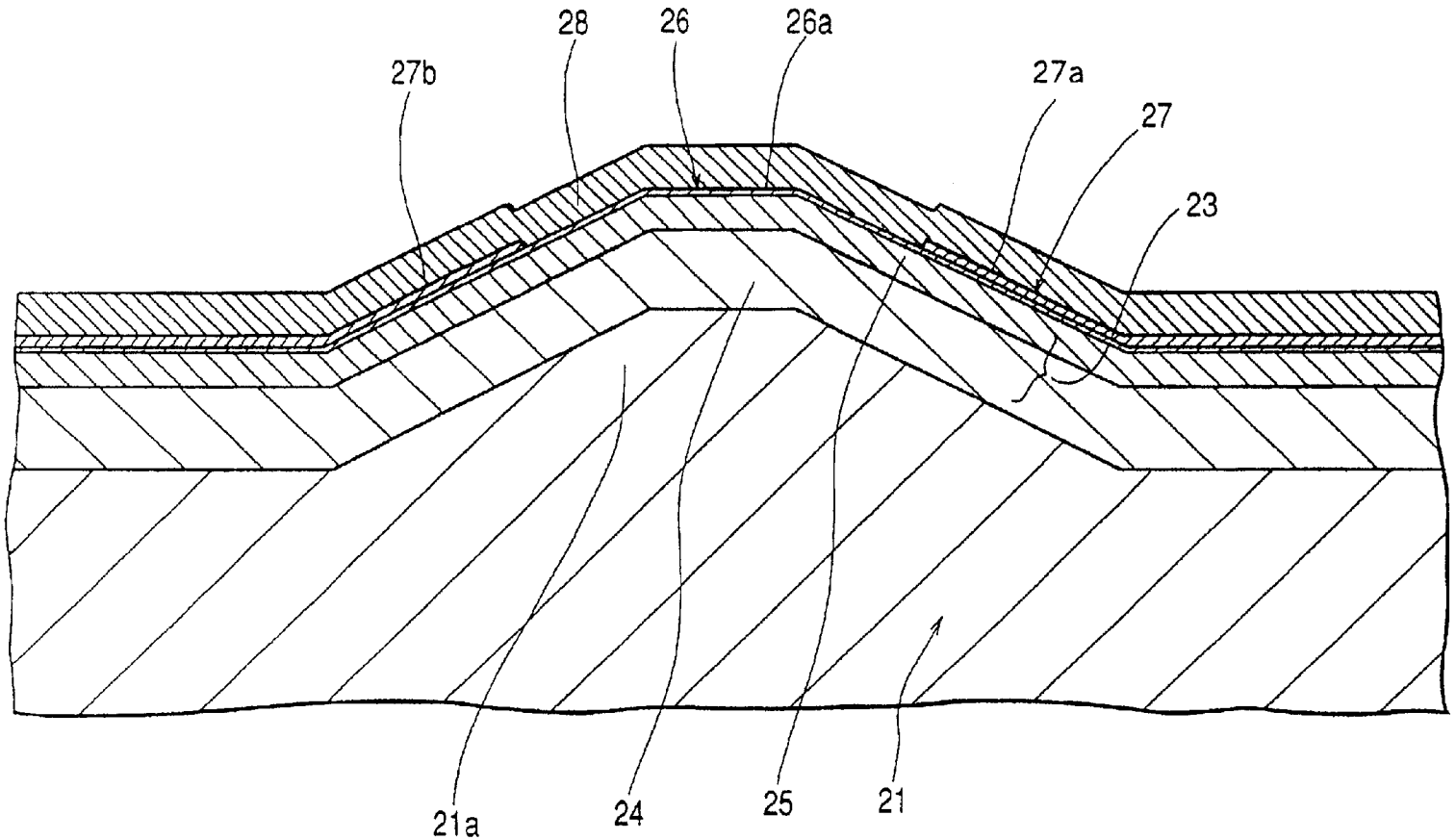
FIG. 2 is a partial cross sectional view showing the structure of a thermal head in accordance with the second embodiment of the present invention.
Figure 3:
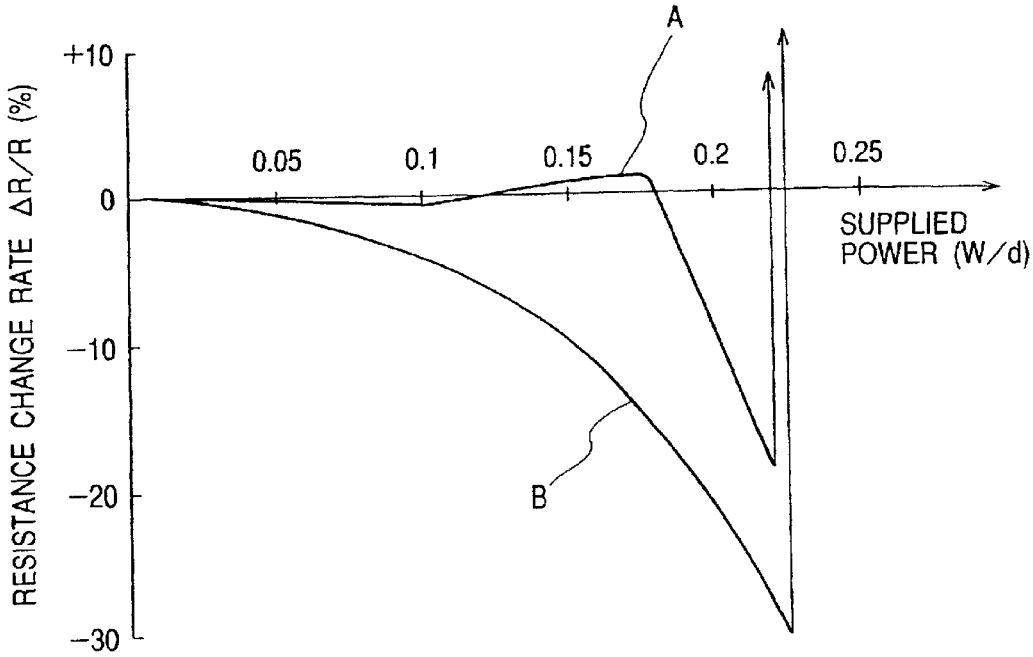
FIG. 3 is a graph for describing the relation between the supplied power and the resistance change rate for a heat resistor in the cases of with and without thermal insulation layer in accordance with the present invention.

FIG. 2 shows the second embodiment of the present invention. In this case, a convex 21*a* is monolithically formed directly to form the top face of a radiative substrate 21 comprising a single crystal silicon wafer or metal plate by means of photolithographic technique, polishing technique, or pressing technique.

A thermal insulation layer 23 comprising an organic thermal insulation layer 24 and an inorganic high thermal insulation layer 25, which are the same as used in the first embodiment, is formed on the radiative substrate 21, and a heating resistor 26, a power supplier 27, and a protection layer 28 are laminated on the top face of the thermal insulation layer 23. These components forms the thermal head in accordance with the second embodiment.

The method for manufacture of the thermal head in accordance with the second embodiment will be described hereunder. The same manufacture method for manufacturing the thermal head in accordance with the first embodiment is used in the second embodiment excepting that the glaze layer 12 is not formed but the convex 21*a* is formed monolithically on the radiative substrate 21. The description of the manufacture process is omitted excepting the different point.

In the case of the thermal head in accordance with the second embodiment, the glaze layer 12 described in the first embodiment is unnecessary, and the manufacture process is simplified.

Figure 4:
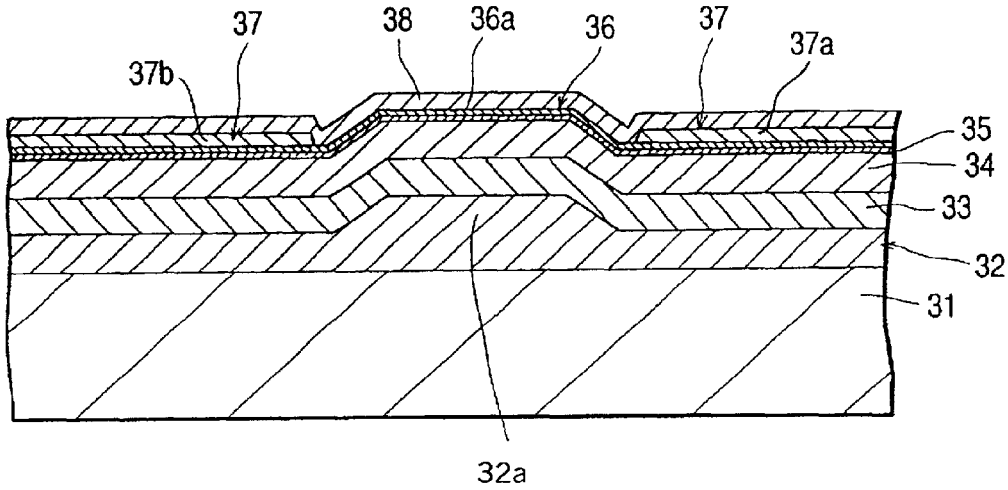
FIG. 4 is a partial cross sectional view showing the structure of a thermal head in accordance with the third embodiment of the present invention.
Figure 5:
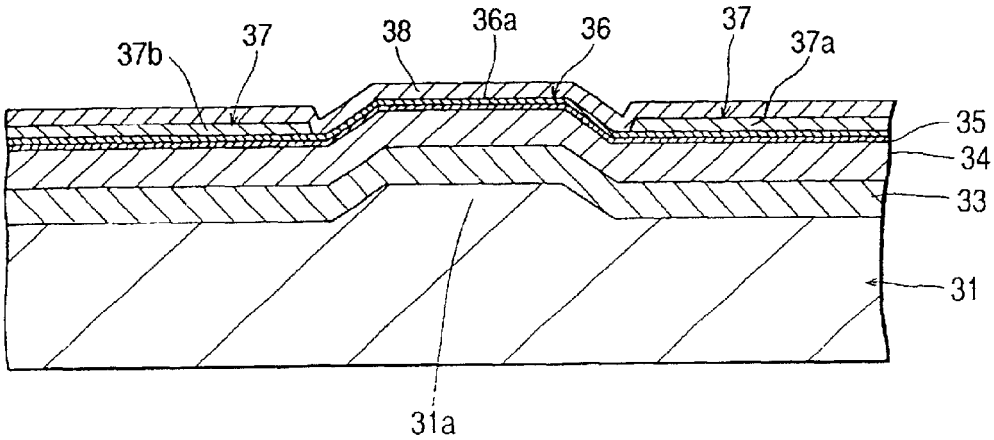
FIG. 5 is a partial cross sectional view showing the structure of a thermal head in accordance with the fourth embodiment of the present invention.
Figure 8:
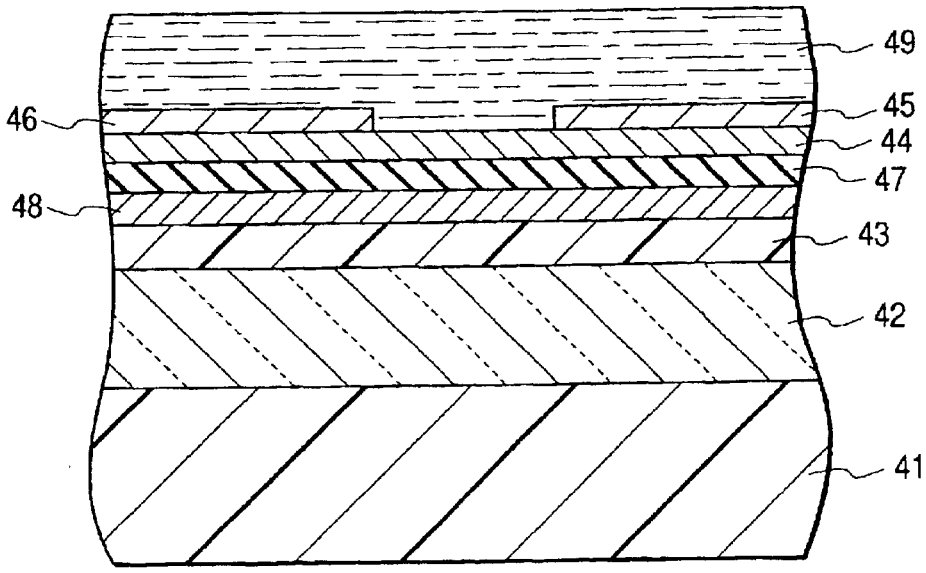
FIG. 8 is a partial cross sectional view showing the structure of a thermal head in accordance with the sixth embodiment of the present invention.
Figure 9:
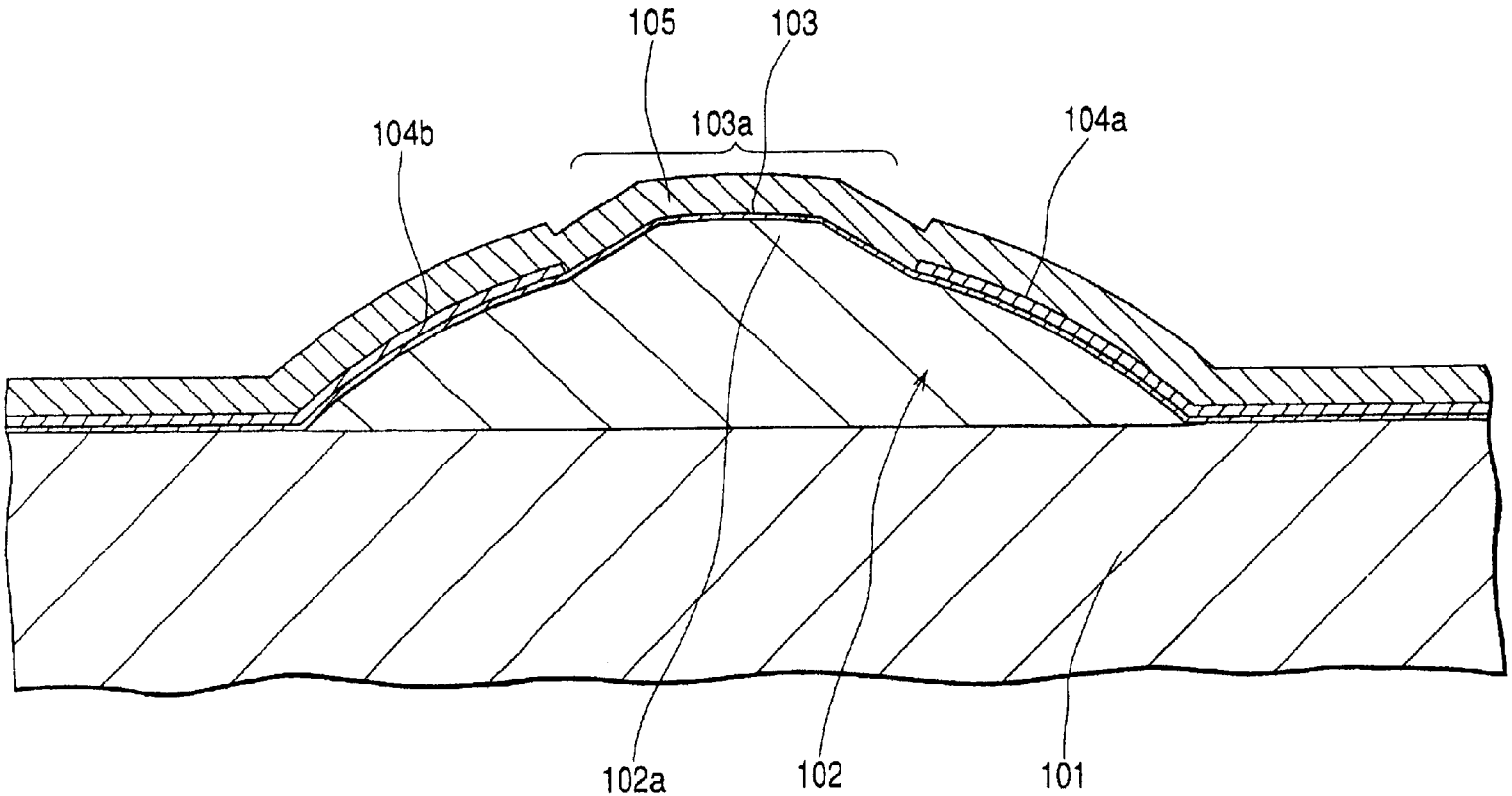
FIG. 9 PRIOR ART
FIG. 9 is a partial cross sectional view showing the structure of a conventional thermal head.

FIG. 4 is a partial cross sectional view of the third embodiment of the present invention, FIG. 5 is a partial cross sectional view of the fourth embodiment of the present invention and FIG. 8 is a view of thermal characteristics of the thermal head of the third and fourth embodiments of the present invention.

At first, a thermal head in accordance with the third embodiment is provided with a glaze thermal insulation layer 32 having a thickness of 30 to 80 μm having glass formed on the entire or partial top face of a radiative substrate 31 that includes alumina as shown in FIG. 4. A convex 32*a* having the cross section in the form of trapezoid ridge having a height of 5 to 15 μm is formed projectingly on the top face of the glaze thermal insulation layer 32.

An organic thermal insulation layer 33 that functions as a thermal insulation layer includes heat resistant polyimide resin having a thickness of 10 to 30 μm is formed on the entire top face of the radiative substrate 31 including the convex 32*a* of the glaze thermal insulation layer 32.

The organic thermal insulation layer 33 is formed by a vacuum evaporation polymerization technique. In detail, for example, the radiative substrate 31 is heated to a temperature of approximately 200° C. with exhaustion of the internal of a vacuum chamber, and gasified two component monomers used to form polyimide resin are then introduced to cause a chemical reaction in the vacuum chamber. Thereby, the organic thermal insulation layer 33 having an even thickness is formed as a laminate so as to have the same configuration as that of the top face of the radiative substrate 31.

Thereafter, the laminate film is subjected to heat treatment at a temperature of 400 to 600° C. to complete the reaction of un-reacted components or to remove un-reacted components. As the result, a high heat resistant organic thermal insulation layer 33 containing less residual gas to be degassed is formed.

Furthermore, it is possible to form a polyimide film having a thickness of 10 to 30 μm as the organic thermal insulation layer 33 using several tens of grams of raw material monomer by applying an evaporation polymerization technique. As the result, a polyimide film to be used as the organic thermal insulation layer 33 can be formed at a reduced material cost.

Furthermore, the thermal diffusivity of the organic thermal insulation layer 33 is as low as approximately 0.11 $mm^2$/sec in comparison with the thermal diffusivity of the glaze thermal insulation layer 32 of approximately 0.45 $mm^2$/sec, namely approximately ¼ of the glaze thermal insulation layer 32.

Therefore, the heat generated from the heating element 36*a*, that will be described hereinafter, is accumulated in the organic thermal insulation layer 33, and the heat transfer to the radiative substrate 31 can be suppressed. As the result, the temperature drop of the heating element 36*a* is reduced during printing and the high quality printing is realized.

Furthermore, on the top face of the organic thermal insulation layer 33, an inorganic thermal insulation layer 34 having a thickness of 5 to 20 μm and including a combination of Si, transition metal, and oxygen, or complex oxide of nitrogen, or nitride ceramic is formed to thermally reinforce the polyimide resin.

Because the inorganic thermal insulation layer 34 is formed as a low density black film in which oxygen or nitrogen is insufficiently contained by means of reactive sputtering technique under high gas pressure, the thermal diffusivity of the inorganic thermal insulation layer 34 is as low as 0.3 to 0.5 $mm^2$/sec that is excellent in thermal insulation. The inorganic thermal insulation layer 34 is a ceramic layer that contains free active transition metal and adheres firmly on the underlayer.

On the top face of the inorganic thermal insulation layer 34, a high insulating inorganic protection layer 35 having a thickness of 0.1 to 1 μm that includes $SiO_2$, SiC, Si—Al—O, $Al_2O_3$, or AlN is formed to protect the inorganic thermal insulation layer 34 mechanically and chemically.

On the inorganic protection layer 35, a plurality of heating resistors 36 having a high melting point cermet such as Ta—$SiO_2$ is formed in the form of pattern. The heating resistor 36 is subjected to stabilization anneal treatment at a temperature of at least 400° C. or higher.

On the top face of the heating resistor 36, a power supplier 37, which comprises an common electrode 37*a* and individual electrode 37*b*, having a thickness of approximately 1 to 2 μm and that includes a metal such as Al, Cu, or Au is formed to supply the electric power to the heating resistor 36.

On the convex 32*a* disposed between the common electrode 37*a* and the individual electrode 37*b*, the heating element 36*a* is formed in the dot fashion.

Furthermore, on the heating resistor 36, common electrode 37*a* and individual electrode 37*b*, a wear resistance layer 38 having a thickness of approximately 5 μm and including Si—O—N or Si—Al—O—N is laminated to cover the respective underlayers. As the result, a high efficiency thermal head is manufactured.

The thermal head having the structure as described hereinabove is excellent in heat accumulation performance because the four layers including the inorganic thermal insulation layer comprising the glaze thermal insulation layer 32, the organic thermal insulation layer 33 includes polyimide resin, the inorganic thermal insulation layer 34, and the inorganic protection layer 35 are formed to form a laminate in the order from the bottom between the radiative substrate 31 and the heating resistor 36.

Because the heat generated from the heating element 36*a* during printing is accumulated in the inorganic thermal insulation layer 34, the organic thermal insulation layer 33, and the glaze thermal insulation layer 32, and the heat is dissipated slowly through the radiative substrate 31, the temperature drop of the heating element 36*a* is reduced during printing, and the high quality printing is realized.

Furthermore, the electric energy to be supplied to the heating resistor 36 can be reduced, and it is possible to realize a power-saving portable type thermal printer provided with a thermal head of the present invention, and the long battery life is realized.

The radiative substrate 31 that includes alumina is described in the third embodiment of the present invention, but in the fourth embodiment of the present invention, a thermal head may be provided with a radiative substrate 31 formed of single crystal Si or a metal plate, which is highly heat radiative, having no glaze thermal insulation layer 32 as shown in FIG. 5.

Because the radiative substrate 31 is formed of single crystal Si or a metal plate, it is possible to form a convex 31*a* directly on the radiative substrate 31 by means of photolithographic technique, polishing technique, or pressing technique as shown in FIG. 5.

As the result, the thermal head of other embodiments of the present invention can be manufactured easily, and the time required for manufacture of the thermal head is shortened.

The thermal head described in the fourth embodiment of the present invention is excellent in heat accumulation performance because the three layers comprising the organic thermal insulation layer 33 that includes polyimide resin, the inorganic thermal insulation layer 34, and the inorganic protection layer 35 are formed to form a laminate in the order from the bottom between the radiative substrate 31 and the heating resistor 36.

Figure 6:
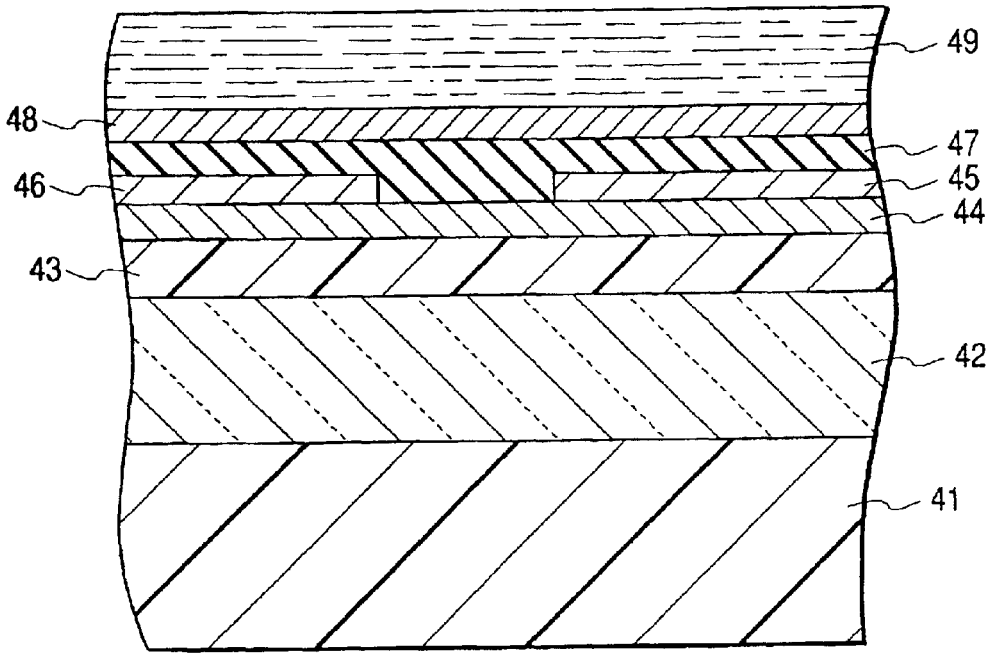
FIG. 6 is a partial cross sectional view showing the structure of a thermal head in accordance with the fifth embodiment of the present invention.

A thermal head in accordance with the fifth embodiment will be described hereunder. FIG. 6 is a partial cross sectional view showing the structure of the thermal head in accordance with the fifth embodiment of the present invention, and FIG. 7 is a plan view of the thermal head.

Figure 7:
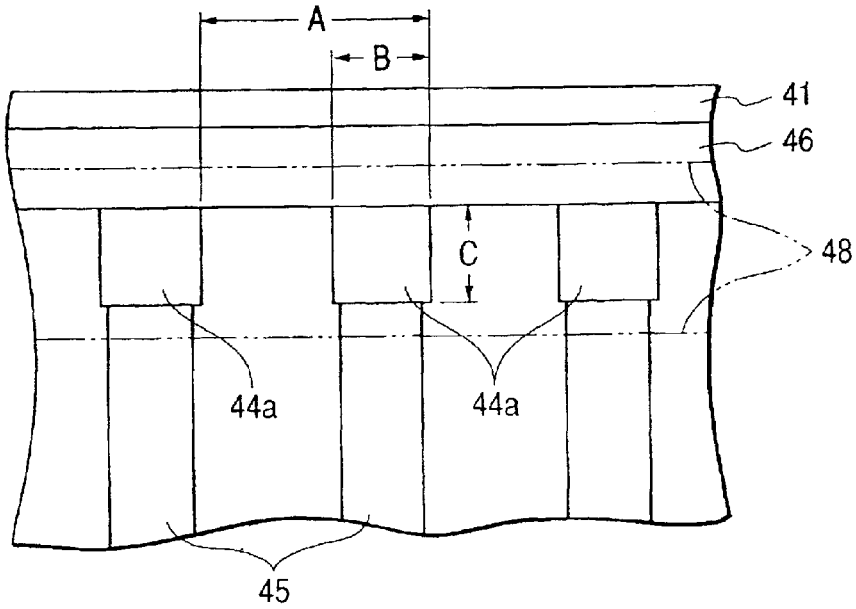
FIG. 7 is a partial plan view of a thermal head in accordance with the fifth embodiment of the present invention shown in FIG. 6.

In FIG. 6 and FIG. 7, 41 denotes a substrate that includes alumina or single crystal silicon, and a glaze thermal insulation layer 42 having a thickness of 40 to 70 μm and that includes glass is formed on the top face of the substrate 41. The glaze thermal insulation layer 42 may have a cross section in the form of approximately trapezoidal convex having a height of 30 to 80 μm as in the case of the thermal head described in the first and third embodiments.

An organic thermal insulation layer 43 having a thickness of 10 to 30 μm and that has a heat resistant resin material such as polyimide is laminated on the top face of the glaze thermal insulation layer 42. On the top face of the organic thermal insulation layer 43, a heating resistor 44 having Ta—$SiO_2$ is formed.

The heating element 44*a* formed on a part of the heating resistor 44 is formed with a forming pitch A between adjacent heating elements 44*a* of 99.2 μm for obtaining 256 dpi resolution so that small dots are printed as shown in, for example, FIG. 8, and the size B in the arranging direction of the heating elements 44*a* is formed with a forming pitch B of 42 μm (42% of the forming pitch A) for obtaining 600 dpi resolution.

In the case where the high resolution as high as 800 dpi is to be obtained, the size B of the heating resistor 44 is formed with the forming pitch of 31.75 μm (32% of the forming pitch A).

Furthermore, the size C in the direction that is orthogonal to the arrangement of the heating elements 44*a* is formed so that the aspect ratio is in the range from 0.8 to 1.5 with respect to the size B in the arrangement direction to print clear dots.

An individual electrode 45 and common electrode 46 having a thickness of 1 to 3 μm and that includes Al, Cu, or Au are connected to the heating resistor 44. An electrical insulation film 47 having a thickness of approximately 1 μm and that includes $SiO_2$ is laminated on the top face of these heating resistor 44, the individual electrode 45, and the common electrode 46. On the top face of the electrical insulation film 47, a thermal diffusion layer 48 having a thickness of 0.1 to 1.0 μm and including a high melting point metal such as Ti is formed.

The thermal diffusion layer 48 has a width slightly wider than the size C of the heating element 44*a* and is laminated in the longitudinal direction of the arrangement of the heating elements 44*a* on the top face of the area on which the heating resistor 44 is formed as shown with chain double-dashed lines in FIG. 8.

On the top face of the thermal diffusion film 48, a protection layer 49 having a thickness of 5 to 10 μm and including Si—O—N or Si—Al—O—N is laminated to prevent oxidation and wearing of the heating resistor 44, the individual electrode 45, and the common electrode 46.

In the case of the thermal head having the structure as described hereinabove, because the heat generated from the heating element 44*a* when a current is supplied to the individual electrode 45 and the common electrode 46 is dissipated quickly in the a real direction (horizontal direction) through the thermal diffusion layer 48, it is possible to print a signal dot surely even in the initial stage at the starting of printing, and a high resolution print image can be obtained.

As the result, the thermal head having the heating element 44*a* with a small forming size can retain sufficient thermal energy between adjacent heating elements 44*a* and 44*a* when a suitable electric energy is supplied to the heating element 44*a*, the dot diameter of a dot that is printed is widened, the space between dots is covered with printing, and the sufficient printing density is obtained as a whole.

Next, the sixth embodiment of the present invention will be described with reference to FIG. 8. FIG. 8 is a partial cross sectional view showing the structure. The sixth embodiment is different from the abovementioned fifth embodiment in that the positional relation of the heating resistor 44 and the thermal diffusion layer 48 is different each other. In detail, in the case of the sixth embodiment, the thermal diffusion layer 48 is formed on the top face of the organic thermal insulation layer 33, and the heating resistor 44, the common electrode 45, and the individual electrode 46 are formed on the top face of the thermal diffusion layer 48 with interposition of the electric insulation layer 47.

The thermal head of the sixth embodiment having the structure as described hereinabove can provide the same effect as provided by the thermal head in accordance with the fifth embodiment.

As described hereinabove, the thermal head of the present invention is manufactured according to a method in which heat resistant resin is used as the material of the thermal insulation layer, many heating resistors are formed on the top face of the organic thermal insulation layer, and the thermal diffusion layer is formed on the top face of the heating resistor with interposition of the electric insulation film, or the thermal diffusion layer is formed on the bottom face of the heating resistor with interposition of the electric insulation layer. As the result, the energy saving thermal head is realized, and the heat generated from the heating resistor by supplying a current to the individual electrode and the common electrode is dissipated quickly in the a real direction (horizontal direction) through the thermal diffusion layer.

Because of the above, a single dot can be printed surely even in the initial stage at the starting of printing, the dot diameter of a dot to be printed is widened by supplying a suitable amount of electric energy to the heating resistor as required and the space between dots is covered with printing, and sufficient printing density is obtained as a whole by use of the thermal head having a heating resistor with a small forming size to obtain a high resolution printed image. As the result, a high quality printed image can be obtained.

What is claimed is:

1. A thermal head comprising:

a thermal insulation layer on a radiative substrate;

a plurality of heating resistor elements on a top face of the thermal insulation layer;

a power supplier including an individual electrode and a common electrode connected to the heating resistor elements to supply power to a heating resistor; and a protection layer that covers surfaces of at least the heating resistor elements and the power supplier, wherein the thermal insulation layer includes an organic thermal insulation layer having a polyimide resin, and wherein a thermal diffusion layer is formed on bottom faces of the heating resistor elements with interposition of an electric insulation film.

2. The thermal head according to claim 1, wherein the thermal diffusion layer comprises a high melting point metal.

* * * * *

UNITED STATES PATENT AND TRADEMARK OFFICE

CERTIFICATE OF CORRECTION

PATENT NO. : 7,046,265 B2
APPLICATION NO. : 10/058815
DATED : May 16, 2006
INVENTOR(S) : Hirotoshi Terao It is certified that error appears in the above-identified patent and that said Letters Patent is hereby corrected as shown below:

On the Title Page

In column 1, item (12), delete "Shirakawa et al." and substitute --Terao-- in its place.

In column 1, item (75), delete "Takashi Shirakawa, Iwate-ken (JP); Satoru Sasaki, Iwate-ken (JP);".

In column 2, under "U.S. PATENT DOCUMENTS", insert the following.

| | | |
|---|---|---|
| --4,963,893 | 10/1990 | Homma et al. |
| 5,119,112 | 06/1992 | Homma et al. |
| 5.157,107 | 10/1992 | Nikaido et al. |
| 5,157,414 | 10/1992 | Seino et al. |
| 5,177,498 | 01/1993 | Homma et al. |
| 5,444,475 | 08/1995 | Mitani--. |

In column 2, after line 3, under "U.S. PATENT DOCUMENTS", insert the following.

--FOREIGN PATENT DOCUMENTS

| | | |
|---|---|---|
| --JP | 52-100245 | 08/1977 |
| EP | 0 367 122 | 05/1990 |
| EP | 0 459 481 | 12/1991 |
| JP | 8-267806 | 10/1996 |
| JP | 0 930 9218 | 12/1997 |
| EP | 0 251 036 | 01/1998--. |

Signed and Sealed this

Eighth Day of May, 2007

JON W. DUDAS
*Director of the United States Patent and Trademark Office*